United States Patent [19]

Glasser et al.

[11] 4,129,112

[45] Dec. 12, 1978

[54] HEAT EXCHANGE APPARATUS

[75] Inventors: Alan Glasser; Jens P. Schwarz, both of 101 Tenby Rd., Havertown, Pa. 19083; Lance A. Glasser, Mattapan, Mass.

[73] Assignees: Alan Glasser; Jens P. Schwarz, both of Havertown, Pa.

[21] Appl. No.: 712,987

[22] Filed: Aug. 9, 1976

[51] Int. Cl.[2] ..... F24B 7/00

[52] U.S. Cl. ..... 126/121; 138/38; 165/175; 237/51

[58] Field of Search ..... 126/121, 122, 129, 131, 126/164, 165, 83; 237/51; 138/38; 165/179, 181, 174, 10

[56] References Cited

U.S. PATENT DOCUMENTS

| | | | |
|---|---|---|---|
| 1,468,964 | 9/1923 | Groth | 126/121 |
| 4,018,210 | 4/1977 | Christophel | 126/164 |

FOREIGN PATENT DOCUMENTS

| | | | |
|---|---|---|---|
| 483076 | 5/1917 | France | 126/121 |
| 528244 | 11/1921 | France | 126/83 |
| 133185 | 10/1919 | United Kingdom | 126/121 |
| 135380 | 11/1919 | United Kingdom | 126/121 |
| 291402 | 12/1928 | United Kingdom | 165/10 |
| 417668 | 10/1934 | United Kingdom | 138/38 |
| 895463 | 5/1962 | United Kingdom | 165/10 |

*Primary Examiner*—William F. O'Dea
*Assistant Examiner*—Harold Joyce
*Attorney, Agent, or Firm*—Seidel, Gonda & Goldhammer

[57] ABSTRACT

Heat exchange apparatus for improving the efficiency of a fireplace is disclosed in the form of a plurality of heat transfer conduits connected at one end to a manifold and containing a plurality of heat exchange elements. A fan means directs air through the manifold and then through the conduits for contact with the heat exchange elements to thereby heat the air which is then discharged into a room.

10 Claims, 6 Drawing Figures

FIG. 1
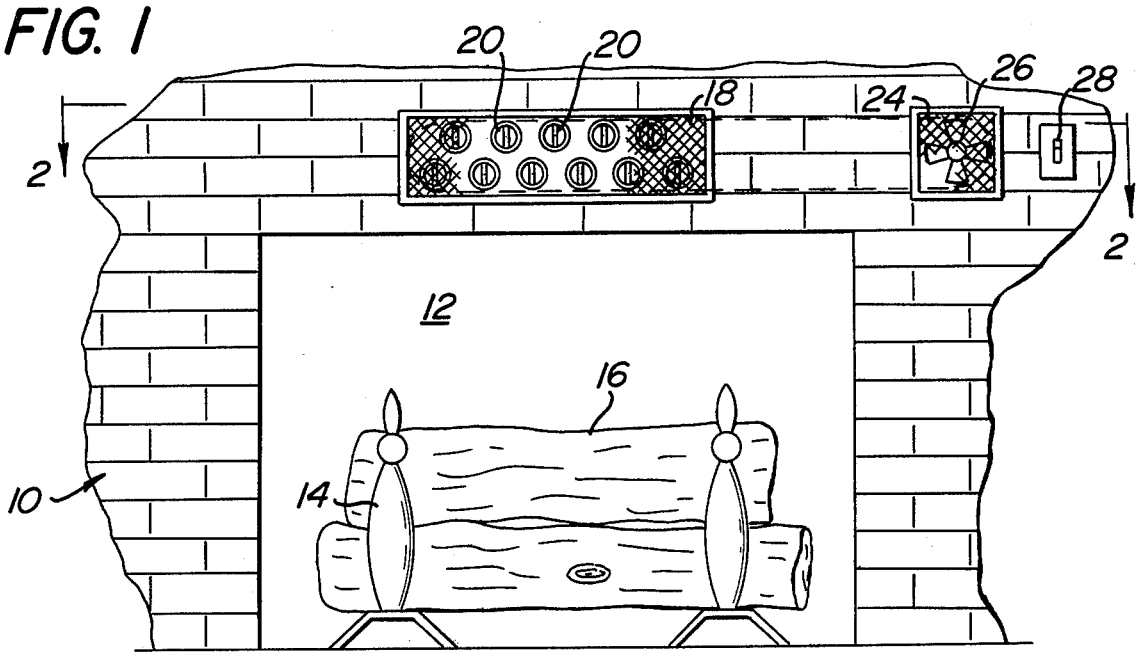
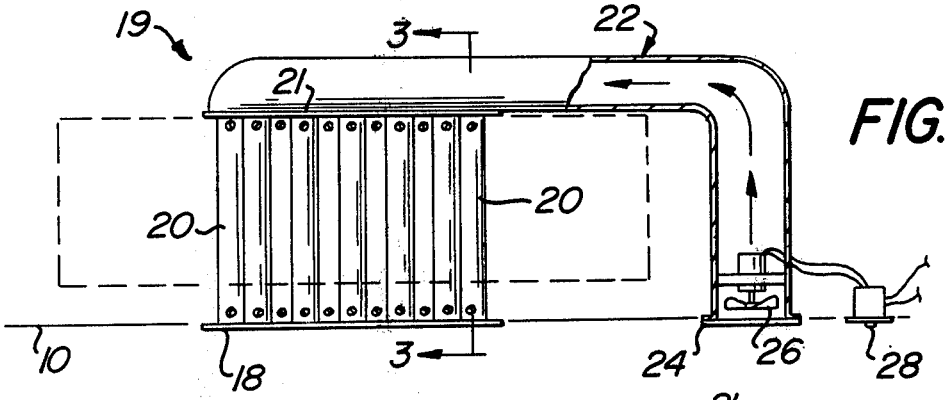
FIG. 2
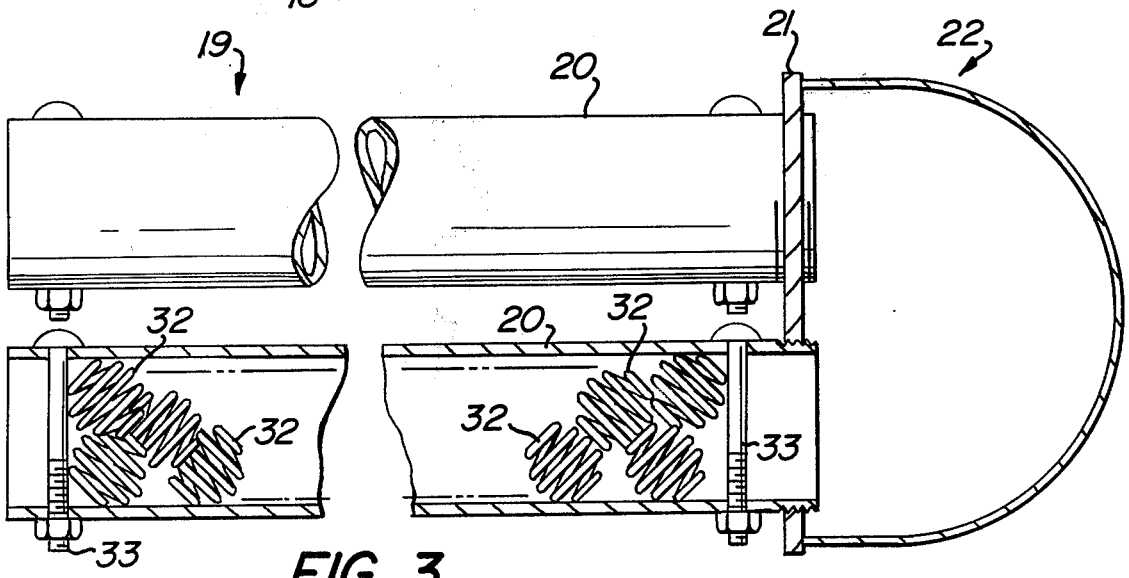
FIG. 3

FIG. 4
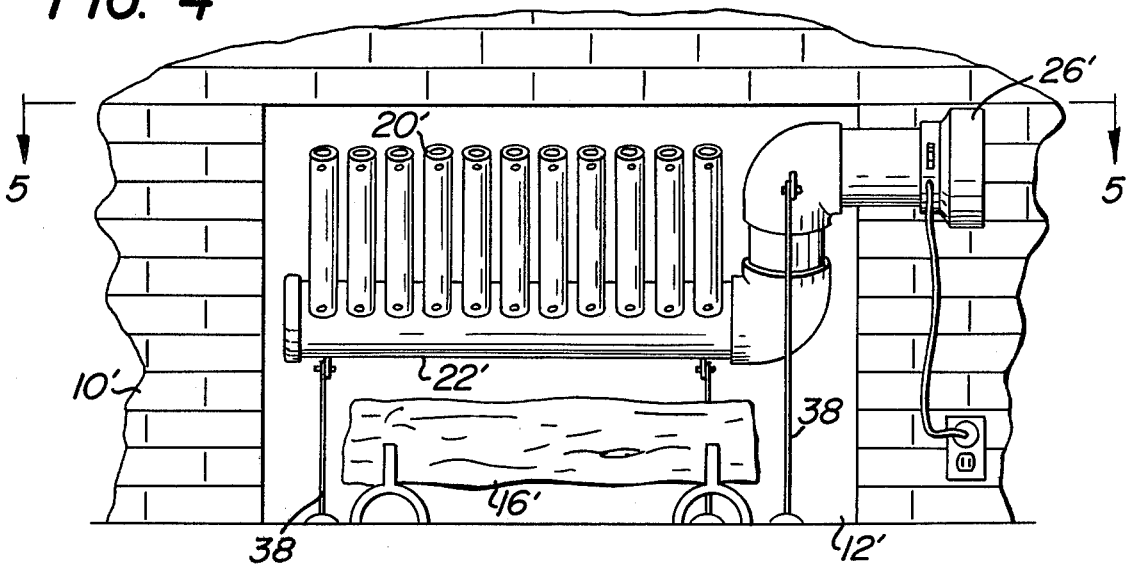
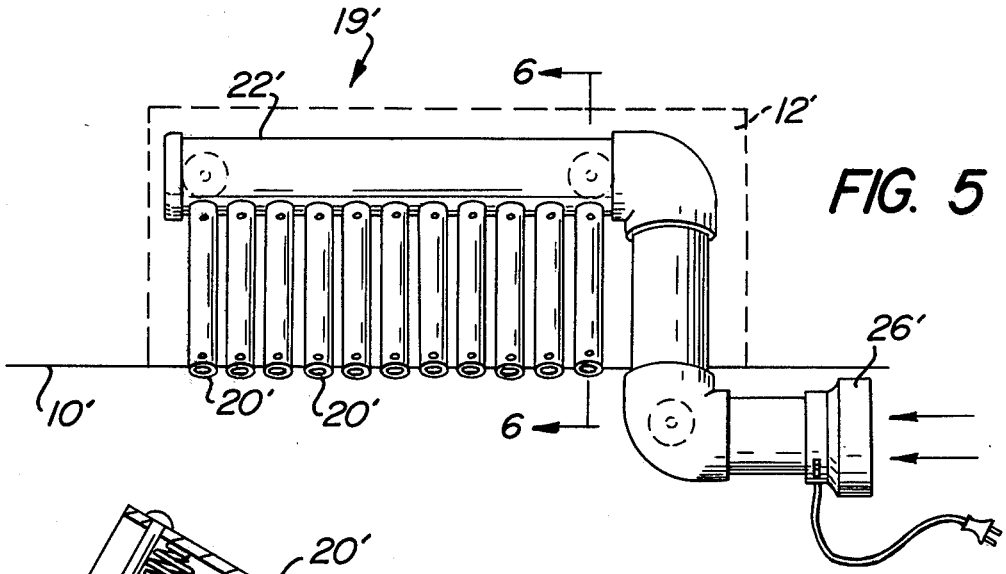
FIG. 5
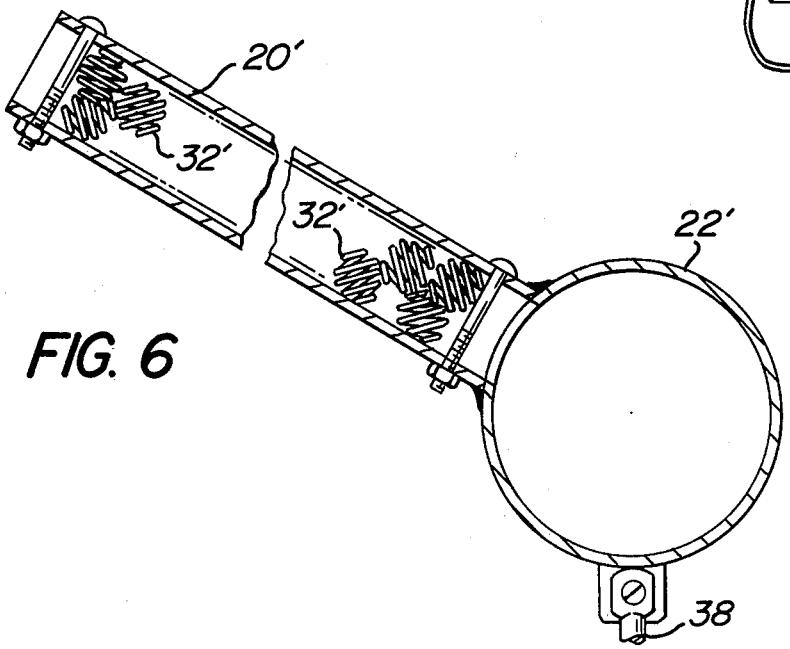
FIG. 6

HEAT EXCHANGE APPARATUS

BACKGROUND

Many rural and suburban homes are equipped with operating fireplaces. A fireplace is notorious for its low efficiency whereby it can only heat a single room and even then at the expense of huge quantities of fuel. There has long been a need for a inexpensive device which is simple, reliable and which substantially increases the thermal efficiency of an operating fireplace.

SUMMARY OF THE INVENTION

The present invention is directed to a heat exchange apparatus for improving the efficiency of a fireplace. The apparatus includes a plurality of conduits connected at one end to a manifold and being open at their other end. A plurality of heat transfer elements are provided in each of the conduits. Each heat transfer element is a good conductive metal. The heat transfer elements are randomly disposed in contact with each other and the inner peripheral surface of their associated conduit thereby providing turbulence to air flow through their associated conduit.

A fan means communicates with the manifold. The fan means causes air flow into the manifold and then through the conduits for discharge thereform at an elevated temperature as a result of contact with the heat transfer elements.

It is an object of the present invention to provide heat exchange apparatus for improving the efficiency of a fireplace while being inexpensive, reliable and efficient.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is an elevation view of a wall containing a fireplace incorporating the apparatus of the present invention.

FIG. 2 is a sectional view taken along the line 2—2 in FIG. 1.

FIG. 3 is a sectional view taken along the line 3—3 in FIG. 2.

FIG. 4 is a view similar to FIG. 1 but showing a portable heat exchange apparatus in accordance with the present invention.

FIG. 5 is a view taken along the line 5—5 in FIG. 4.

FIG. 6 is a view taken along the line 6—6 in FIG. 5.

Referring to the drawing in detail, wherein like numerals indicate like elements, there is shown in FIG. 1 a wall of a room designated generally as 10 and containing a fireplace 12. The fireplace 12 is illustrated as being provided with a conventional set of irons 14 for supporting fuel in the form of logs 16. Other types of fuel such as coal, paper, etc. may be utilized in place of wooden logs.

The embodiment of heat exchange apparatus in accordance with the present invention and shown in FIGS. 1-3 is designated generally as 19. The apparatus 19 is mounted in the wall 10 opposite a grill 18. Grill 18 is above the elevation of the fireplace opening but below the elevation of the damper. Apparatus 19 includes a plurality of conduits 20 which are parallel to one another. Each of the conduits 20 is connected at one end to a plate 21. The conduits 20 adjacent the grill 18 are open except for a heat exchange element retainer as will be made clear hereinafter. A duct, which is generally L-shaped, is connected to the plate 21 to thereby define a manifold 22.

The manifold 22 is supported by the wall 10 so that its inlet end is juxtaposed to a second grill 24. The inlet of the manifold 22 contains a fan 26 coupled to a wall switch 28. The wall switch 28 is alternatively connected to a source of conventional house electrical power or a battery power pack. The battery power pack provides the desirable function of facilitating operation of the apparatus 10 during electrical failures.

A retainer 32 extends diametrically across each end of each of the conduits 20. The retainer may be in the form of a bolt. Within the conduits 20, there is provided a plurality of heat exchange elements 32 randomly disposed in contact with each other and the inner peripheral surface of the conduits 20.

The heat exchange elements 32 are of a good heat conductive metal such as brass. It is preferred that the elements 32 be hollow with a plurality of flow passages communicating with the hollow interior. Further, the generally spherical shape of the elements 32 is preferred, however, the elements may be generally cylindrical. The elements 32 provide for high turbulence to air flow through their associated conduit 20.

For a conventional size fireplace in an average room of a residential home, the fan 26 should be of such a size so as to provide for air flow in the range of 40 to 80 cubic feet per minute. When air flow is below 40 cubic feet per minute, it has been found that the air discharge from the conduits 20 is too hot. When the air flow from the conduits 20 is at a rate above 80 cubic feet per minute, it has been found that there is a tendency to create or induce a suction flow which removes dirt and ash from the fireplace 12 and distributes the same into the room. It has been found that the optimum air flow rate is approximately 60 cubic feet per minute in the environment referred to above. With larger sized fireplaces and larger sized systems, the air flow rate considered to be optimum may be increased.

In FIGS. 4-6, there is illustrated a second embodiment of the present invention wherein corresponding elements are provided with corresponding primed numerals. In FIGS. 4-6, the apparatus 19′ of the present invention is of a portable nature whereby it may be installed in an existing fireplace as compared with the apparatus described above which is mounted within the wall 10.

The apparatus 19′ is identical with that described above except that it is provided with a plurality of legs 38 for supporting the same above the elevation of the fuel to be consumed such as log 16′. It will be noted that the conduits 20′ are angularly disposed with their free ends being at an elevation higher than the elevation of the manifold 22′. The fan 26′ is supported by the portion of the manifold which projects outwardly from the fireplace and parallel to the wall 10′. Otherwise, the embodiment of the invention as shown in FIGS. 4-6 is identical with that described above.

The embodiment of the present invention is capable of quadrupling the efficiency of a conventional fireplace, has low capital equipment cost, has high thermal efficiency, can be used with any one of a variety of conventional fuels such as wood, coal, paper, etc. Each embodiment of the invention is capable of operating without electrical power in an emergency in that the fans required are small enough so that they may be battery operated.

The conduits 20, 20' are preferably of a mild steel called black iron in the trade. The elements 32, 32' are preferably of soft brass which will expand differentially with respect to the steel conduits 20, 20'. Brass is a good conductor of heat and will facilitate the travel of heat throughout the matrix defined by the elements 32, 32'. When air passes through the matrix, its random configuration and large surface area will ensure maximum efficiency of heat transfer with minimal flow losses and minimum air and noise. In a typical installation of the present invention, the fan 26, 26' is a 14 watt fan.

A wide variety of modifications are possible with the embodiments of the present invention. One or more branching ducts may be connected through existing walls to other rooms from either heat exchange apparatus of the present invention. An automatic system may be provided by use of a thermostat control on the switch for operation of the fans. The portable embodiment in FIGS. 4–6 may be suspended from wall brackets within the fireplace instead of being supported by legs 38 as shown.

The elements 32, 32' are preferably of uniform size formed into a sphere having a diameter of about 0.6 inches from wire having a diameter of about 0.1 inches. The space between convolutions should be less than 0.1 inches so that adjacent elements cannot interlock by slipping into each other. The wire may have a length which is 6 to 8 times the diameter of the spheres. The resultant spherical elements will have a porosity of 65–70%.

The present invention may be embodied in other specific forms without departing from the spirit or essential attributes thereof and, accordingly, reference should be made to the appended claims, rather than to the foregoing specification as indicating the scope of the invention.

It is claimed:

1. Heat exchange apparatus for improving the efficiency of a fireplace comprising a manifold, a plurality of conduits connection at one end to said manifold, the other end of said conduits being open, a plurality of discrete generally spherical heat transfer elements in said conduit, the diameter of said elements being substantially less than the diameter of said conduits, said elements being of good heat conductive wire having a length which is about 6 to 8 times the diameter of the spherical elements with the space between adjacent turns being less than the diameter of the wire to prevent the spheres from slipping inside each other, said elements in each conduit being randomly disposed with each other and the inner peripheral surface of their associated conduit thereby providing turbulence to air flow through their associated conduit, a transversely disposed member at each end of each conduit to prevent inadvertent removal of the elements, a fan means communicating with said manifold for causing air flow into the manifold and then through said conduits for discharge therefrom at an elevated temperature as a result of contact with said heat transfer elements.

2. Apparatus in accordance with claim 1 wherein said fan means is constructed to provide for an air flow rate between 40 and 80 cubic feet per minute.

3. Apparatus in accordance with claim 1 wherein said heat transfer elements are of uniform size, and are hollow, and said elements having a plurality of flow passages communicating with their hollow interior.

4. Apparatus in accordance with claim 1 wherein said manifold is horizontally disposed and said conduits are angled upwardly from said manifold.

5. Apparatus in accordance with claim 1 including legs for supporting said manifold within a fireplace.

6. Apparatus in accordance with claim 1 wherein said conduits are straight and inclined slightly with respect to the horizontal so that the discharge end is slightly above the inlet end of the conduits.

7. Heat exchange apparatus for improving the efficiency of a fireplace comprising a manifold, a plurality of parallel conduits connected at one end to said manifold, the other end of said conduits being open, a plurality of hollow heat transfer elements of uniform size in each conduit, said elements being of good heat conductive metal, said elements in each conduit being randomly in contact with each other and the inner peripheral surface of their associated conduit thereby providing turbulence to air flow through their associated conduit, said elements having a plurality of flow passages communicating with their hollow interior, a fan means communicating with said manifold for causing air to flow into the manifold and then through said conduits for discharge therefrom at an elevated temperature as a result of contact with said heat transfer elements, said fan means being constructed to provide for a combined air flow rate of between 40 and 80 cubic feet per minute from said conduits, and said elements being generally spherical and formed of a wire having a length which is about 6 to 8 times the diameter of the spherical elements with the space between adjacent turns being less than the diameter of the wire to prevent the spherical elements from interlocking by partially slipping inside each other.

8. Apparatus in accordance with claim 7 including means for supporting said manifold in a fireplace.

9. Apparatus in accordance with claim 8 wherein said supporting means includes a wall containing the fireplacing opening with each of sid fan and said conduits terminating adjacent a grill in the wall aove the upper edge of the fireplace opening.

10. A subcombination for use in heat exchange apparatus for improving the efficiency of a fireplace comprising a conduit of good heat conductive metal, a plurality of heat transfer elements in said conduit, said elements being of good heat conductive metal, said elements being randomly disposed in contact with each other and the inner peripheral surface of said conduit for providing turbulence to air flow through the conduit, said elements being of uniform size and being hollow, said elements having a plurality of flow passages communicating with their hollow interior, said elements being generally spherical and formed of wire with adjacent turns being spaced from one another by a distance less than the diameter of the wire to prevent the spheres from slipping inside one another, the diameter of the spherical elements being less than the diameter of said conduit.

* * * * *